US007322158B1

(12) United States Patent
Sorkin

(10) Patent No.: US 7,322,158 B1
(45) Date of Patent: Jan. 29, 2008

(54) INTERSECTIONAL REINFORCING BAR SUPPORT WITH C-SHAPED CLAMPS

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 408 days.

(21) Appl. No.: 10/688,186

(22) Filed: Oct. 20, 2003

Related U.S. Application Data

(63) Continuation-in-part of application No. 10/229,939, filed on Aug. 29, 2002, now Pat. No. 6,684,595, which is a continuation-in-part of application No. 09/894,269, filed on Jun. 29, 2001, now Pat. No. 6,557,317.

(51) Int. Cl.
*E04H 12/00* (2006.01)
*E04C 5/16* (2006.01)

(52) U.S. Cl. ..... 52/685; 52/649.8; 52/682; 52/686; 52/689; 52/677; 52/687; 52/719

(58) Field of Classification Search ..... 52/684, 52/685, 687, 678, 677, 649.8, 682, 689, 136, 52/686, 719; 404/136
See application file for complete search history.

(56) References Cited

U.S. PATENT DOCUMENTS

| | | | | | |
|---|---|---|---|---|---|
| 1,456,499 | A * | 5/1923 | Fitz Gerald | 52/295 |
| 3,471,987 | A * | 10/1969 | Yelsma | 52/684 |
| 3,530,634 | A * | 9/1970 | Adams | 52/687 |
| 3,673,753 | A * | 7/1972 | Anderson | 52/685 |
| 4,756,641 | A * | 7/1988 | Hartzheim | 404/136 |
| 4,835,933 | A * | 6/1989 | Yung | 52/685 |
| 5,107,654 | A * | 4/1992 | Leonardis | 52/685 |
| 5,555,693 | A | 9/1996 | Sorkin | |
| D388,312 | S | 12/1997 | Sorkin | |
| 5,791,095 | A | 8/1998 | Sorkin | |
| 5,819,493 | A * | 10/1998 | LeMoignan | 52/678 |
| 5,893,252 | A * | 4/1999 | Hardy et al. | 52/685 |
| 6,161,360 | A * | 12/2000 | Smith | 52/678 |
| 6,276,108 | B1 * | 8/2001 | Padrun | 52/684 |
| 6,557,317 | B2 * | 5/2003 | Sorkin | 52/684 |
| D480,291 | S | 10/2003 | Sorkin | |
| D482,262 | S * | 11/2003 | Sorkin | D8/354 |
| 6,663,316 | B1 * | 12/2003 | Harris | 404/136 |
| 6,684,594 | B1 * | 2/2004 | Sorkin | 52/685 |
| 6,684,595 | B1 * | 2/2004 | Sorkin | 52/685 |
| 6,837,017 | B2 * | 1/2005 | Hardy et al. | 52/685 |
| 6,925,771 | B2 * | 8/2005 | Lee et al. | 52/685 |
| 2003/0000170 | A1 * | 1/2003 | Sorkin | 52/677 |
| 2004/0040247 | A1 * | 3/2004 | Morse | 52/649.8 |
| 2005/0005564 | A1 * | 1/2005 | Bennett et al. | 52/677 |

* cited by examiner

*Primary Examiner*—Robert Canfield
*Assistant Examiner*—Hunter M Dreidame
(74) *Attorney, Agent, or Firm*—Egbert Law Offices

(57) ABSTRACT

A concrete reinforcing bar support has a base, a support structure extending upwardly from the base with a channel formed at an upper surface thereof, a first clamping structure affixed to the support structure on one side of the channel, and a second clamping structure affixed to the support structure on an opposite side of the channel. A first rebar extends through the channel. A second rebar is retained by the first and second clamping structures in a direction transverse to the first rebar. Each of the first and second clamping structures has generally C-shaped configuration.

2 Claims, 2 Drawing Sheets

INTERSECTIONAL REINFORCING BAR SUPPORT WITH C-SHAPED CLAMPS

RELATED U.S. APPLICATIONS

The present application is a continuation-in-part of U.S. patent application Ser. No. 10/229,939, filed on Aug. 29, 2002 now U.S. Pat. No. 6,684,595 and entitled "Intersectional Reinforcing Bar Support". U.S. patent application Ser. No. 10/229,939, was a continuation-in-part of U.S. patent application Ser. No. 09/894,269, filed on Jun. 29, 2001 now U.S. Pat. No. 6,557,317, and entitled "Concrete Reinforcing Bar Support".

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to devices for use in connection with construction. More particularly, the present invention relates to reinforcing bar chairs for use in reinforced concrete construction. Furthermore, the present invention relates to intersectional chairs used with reinforced concrete construction.

BACKGROUND OF THE INVENTION

In reinforced concrete construction applications, such as highways, floors, or walls of buildings, spacer devices, commonly referred to as chairs, are required for supporting and maintaining reinforcing rods or bars which are positioned in the area where concrete is to be poured. These reinforcing rods are sometimes referred to as "rebars". Depending on such parameters, such as the total surface area and the thickness of the end product of concrete, reinforcement is mandated in varying degrees by building codes. One such method of reinforcement involves a steel mesh, while in major concrete construction, such as highways and high-rise buildings, reinforcing rods of various diameters, typically one-half inch or more, are required. In addition, on such jobs, the reinforcing bars may be positioned in spaced layers due to the thickness of the floor. In some installations, a first layer of rebar is provided, with the reinforcing rods or rebars in spaced parallel relationship, and generally parallel to the surface on which the concrete is to be poured. A second layer of rebar is then added, with the orientation of the second layer perpendicular to the first layer, thus forming a grid or lattice work. After the reinforcing bars or lattice work is prepared, the concrete is then poured over this grid or framework, which is ultimately embedded within the highway floor or wall.

For a concrete floor on a prepared surface, spacers or chairs are utilized for providing the vertical separation of the rebar grid from the surface on which the concrete is to be poured. The prepared surface may be a wood, plywood, or foam structure or a compacted surface, the latter of which my be provided with a layer of compacted sand, with a plastic sheet covering thereon providing a moisture barrier. Spacers or chairs are then positioned on the prepared surface for supporting the rebars in a plane generally parallel to the prepared surface. Typically, with modern building codes, a spacer is needed for every linear foot of the rebar.

With rebar spacers or chairs, one common problem is occasioned by the number of different sizes required to be maintained by a supplier to accommodate different thicknesses of poured concrete, such as two-inch, three-inch, four-inch, etc. and many intermediate fractional sizes. Another common problem with rebar spacers has been encountered in the method of securing the rebar to the chair or spacer, with twisted wire being the most common method. This particular problem is more acute when mutually perpendicular layers of rebar are coupled to the same chairs or spacers. With wire connections, a first strip of wire secures the first layer and a second strip of wire secures the perpendicular layer of rebar. With any metal or wire within the reinforcing bar grid work, there is a problem with rusting or decomposing of the wire or metal components.

In the past, various patents have issued relating to these chair supports for reinforcing rods. In particular, the present inventor is the owner of U.S. Pat. Nos. 5,555,693 and 5,791,095 for such chairs. Each of these chairs has a receiving area with a horizontal section and a generally parabolic section extending transverse to the horizontal section. A plurality of separate legs extends downwardly from the receiving area. Each of the legs has a foot extending horizontally outwardly therefrom. The receiving area and the plurality of legs are integrally formed together of a polymeric material.

U.S. Pat. No. 3,788,025, issued on Jan. 29, 1974 to S. D. Holmes, describes a chair for supporting in right angular relation two reinforcing rods used in construction. The chair has a lower arched base part and an upper rod supporting part integral with the base. The base is an arched support with means for providing lateral, longitudinal, vertical support and strength. The rod supporting part comprises two spaced apart arms, the lower parts of which form a saddle for receiving one reinforcing rod and the upper part for each of which is formed by two separate spaced upstanding inwardly concave arms, the upper ends of which are spaced to provide an opening through which a second reinforcing rod, arranged at a right angle to the first rod, may be introduced.

U.S. Pat. No. 3,673,753, issued on Jul. 4, 1972 to G. C. Anderson, teaches a concrete reinforcing bar support in which a base supports an upright pedestal. A lower clamping portion is supported by the pedestal which has a first rod-receiving open passageway therethrough. Resilient detents extend from the lower clamping portion to retain a reinforcing rod disposed through the first passageway. An upper clamping portion is provided which includes a pair of hook members extending from the lower clamping portion. Each of the hook members has a mouth opening in the same direction to define a second rod-receiving passageway which is normally disposed to the first passageway.

U.S. Pat. No. 4,835,933 issued on Jun. 6, 1989 to F. P Yung, describes a spacer assembly which includes a spacer with a body having a base portion with a generally centrally disposed support post portion. One end of the support post portion is formed as a planar surface with a centrally located generally concave saddle portion configured for receiving a reinforcing bar. The planar surface is provided with apertures therethrough on both sides of the saddle. A clamp member is provided for simultaneously securing mutually perpendicular rebars to the chair. The clamp member is a generally U-shaped lower portion, with the depending arms thereof in spaced generally parallel relationship for engaging a first bar within the saddle. A generally identical pair of hook arms extends upwardly from the bight portion. The hook arms are oriented for engaging a second rebar in an orientation perpendicular to the first rebar engaged within the saddle portion.

U.S. Pat. No. 5,893,892, issued on Apr. 13, 1999 to Hardy, Jr. et al, teaches an apparatus for fixating and elevating an interconnected rebar lattice having individual longitudinal and transverse rebar intersections. The apparatus includes a holding portion having an open-ended recess with two opposing walls being generally U-shaped. The recess has longitudinal access and is sized and shaped to receive a longitudinal rod. An arc-shaped portion extends laterally outwardly from each opposing wall and perpendicular to the longitudinal access of the recess. The arc-shaped portion includes a recess and an opposing wall with each wall including a snap-type lock. A locking member has a generally arc-type portion and includes a snap-type lock for attaching to the arc-type portion and engaging with the snap-type lock of the arc-type portion. A leg portion extends downwardly from the holding portion and is integrally attached to a base.

Recently, various tests have been carried out with regard to bar supports. A common type of test employed determine the integrity of the chair for the support of rebars and/or wire mesh. This test is known as a "dragging" test. Often, specifications for construction jobs require the particular chairs to withstand the dragging of the wire mesh and/or rebar for a desired distance. As a result, it is a requirement that such intersectional chairs remain secured in their proper positions even though the rebars are being dragged to a particular position.

In the past, various bar supports have been made entirely of plastic materials, such as relatively inexpensive polystyrene, polypropylene or polyethylene. Generally, in the past, the use of nylon has been avoided because of the water retention characteristics of nylon. As such, the benefits of nylon have not been used in conventional chairs in the past.

It is an object of the present invention to provide a bar support which is corrosion-proof.

It is another object of the present invention to provide a bar support that is adaptable to receive various diameters of rebar therein.

It is another object of the present invention to provide a bar support adapted for use at intersections of rebars.

It is another object of the present invention to provide a bar support that can be placed on various flat surfaces.

It is another object of the present invention to provide a bar support that can be easily snap-fitted onto and locked around a reinforcing bar.

It is another object of the present invention to provide a bar support which allows a free flow of concrete therethrough.

It is a further object of the present invention to provide a bar support with a load-resistant stable support structure.

It is another object of the present invention to provide a reinforcing bar support that can retain the rebar even during dragging of the associated wire mesh and/or rebar.

It is still a further object of the present invention to provide a reinforcing bar support that achieves the advantages associated with the use of nylon material.

It is a further object of the present invention to provide a reinforcing bar support which is easy to use, easy to manufacture and relatively inexpensive.

These and other objects and advantages of the present invention will become apparent from a reading of the attached specification and appended claims.

BRIEF SUMMARY OF THE INVENTION

The present invention is a concrete reinforcing bar support comprising a base, a support structure extending upwardly from said base and having a channel formed in an upper surface thereof, a first clamping structure affixed to the support structure on one side of said channel, and a second clamping structure affixed to on an opposite side of said channel. A first rebar is received in the channel of the support structure. A second rebar extends in a transverse direction to the first rebar and is retained by the first and second clamping structures in a position above the first rebar. Each of the first and second clamping structures has a generally C-shaped configuration.

In the present invention, each of the first and second clamping structures has a generally C-shaped member extending flexibly upwardly from the support structure and an arm extending upwardly from a bottom of the C-shaped member. The arm has an upper portion in spaced relationship to a top of the generally C-shaped member. The arm also has a lip at the upper portion. This lip extends in a direction away from the top of the C-shaped member. The upper portion of the arm is spaced from the top of the C-shaped member by a distance less than a diameter of the second rebar. The arm is flexibly connected to a bottom of the C-shaped member. The first clamping structure has a rib formed therewith which extends of an exterior surface of the first clamping structure. The second clamping structure also has a rib formed therewith and extending outwardly of an exterior of the second clamping structure. The rib of the first clamping structure is formed on a surface of the first clamping structure adjacent to the channel. The rib of the second clamping structure is formed on a surface of the second structure adjacent to the channel. A first gusset extends outwardly of a side of the support structure and is affixed to an underside of the first clamping structure. A second gusset extends outwardly of an opposite side of the support structure and is affixed to an underside of the second clamping structure.

In the present invention, the support structure includes a first leg extending upwardly from one side of the base, a second leg extending upwardly from an opposite side of the base, and a third leg extending upwardly from the base between the first and second legs. The first and second legs extend at an acute angle upwardly from the base. The third leg extends vertically from the base and generally equidistant between the first and second legs. The support structure also includes a first gusset affixed to the base and joined to an exterior surface of a bottom of a first leg, and a second gusset affixed to the base and joined to an exterior surface of a bottom of a second leg.

In the present invention, each of the first and second clamping structures is positioned above the channel. In the present invention, the base, the support structure, the first clamping structure and the second clamping structure are integrally formed together of a nylon material. The support structure has a plurality of holes formed therein so as to allow concrete to flow therethrough.

DETAILED DESCRIPTION OF THE INVENTION

Figure 1:
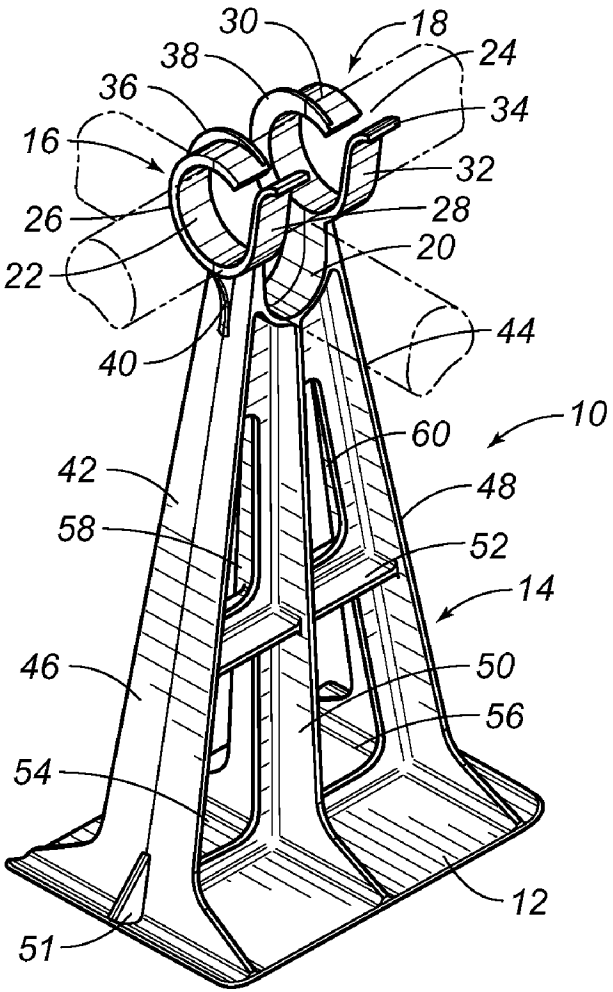
FIG. 1 is a perspective view of the reinforcing bar support in accordance with the preferred embodiment of the present invention.

Referring to FIG. 1, there is shown the concrete reinforcing bar support 10 in accordance with the preferred embodiment of the present invention. The concrete reinforcing bar support 10 includes a base 12, a support structure 14, a first clamping structure 16 and a second clamping structure 18. The support structure 14 extends upwardly from the base 12. The support structure 14 has a channel 20 formed in an upper surface thereof. This channel 20 extends in a direction and has a size suitable for receiving a first rebar therein. The first clamping structure 16 is affixed to the support structure 14 on one side of the channel 20. The first clamping structure 16 has an interior surface 22 suitable for receiving a second rebar therein such that the second rebar extends in a direction transverse to the first rebar. The first rebar is received in channel 20. The second clamping structure 18 is affixed to the support structure 14 on an opposite side of the channel 20. This second clamping structure 18 has an interior surface 24 suitable for receiving the second rebar therein. The second clamping structure 18 is in spaced parallel relationship to the first clamping structure 16. As can be seen, the first clamping structure 16 and the second clamping structure 18 each have a generally C-shaped configuration.

Specifically, the first clamping structure 16 has a generally C-shaped member 26 extending flexibly upwardly from the support structure 14. An arm 28 extends upwardly from a bottom of the C-shaped member 26. This arm 28 has a upper portion that is in spaced parallel relationship to a top of the C-shaped member 26. Similarly, the second clamping structure 18 also has a generally C-shaped member 30 extending flexibly upwardly from the support structure 14. An arm 32 extends upwardly from a bottom of the C-shaped member 30. This arm 32 has an upper portion 34 that is in spaced relationship to a top of the C-shaped member 30.

In each of the first clamping structure 16 and the second clamping structure 18, the respective arms 28 and 32 have a lip 34 at the upper portions thereof. This lip 34 extends in direction away from the top of the respective C-shaped members 26 and 30. The upper portion of the respective arms 28 and 30 are spaced from the respective tops of the C-shaped members 26 and 30 by a distance less than a diameter of the second rebar. It can be seen that the arm 28 is flexibly connected to a bottom of the C-shaped member 26. Similarly, the arm 32 is flexibly connected to the bottom of the C-shaped member 30.

The first clamping structure 16 has a rib 36 formed on a surface of the first clamping structure 16 adjacent to the channel 20. Similarly, the second clamping structure 18 has a rib 38 formed on a surface of the second clamping structure 18 adjacent to the channel 20. The rib 36 is positioned so as to face the rib 38. The ribs 36 and 38 are formed with the respective C-shaped members 26 and 30 so as to provide structural integrity to each of the C-shaped members 26 and 30. The structural integrity imposed by the use of ribs 36 and 38 further facilitates the ability of the concrete reinforcing bar 18 to withstand the dragging tests imparted thereto.

A first gusset 40 extends outwardly of a side 42 of the support structure 14 and is affixed to an underside of the first clamping structure 16. More particularly, the gusset 40 is secured to the first clamping structure 16 in a location generally corresponding to where the arm 28 is joined to the C-shaped member 26. A similar arrangement of a gusset is also applied to the opposite side 44 of the support structure 14.

The support structure 14 has a first leg 46 extending upwardly from one side of the base 12. The support structure 14 also has a second leg 48 extending upwardly from an opposite side of the base 12. A third leg 50 extending upwardly from the base 12 in a position generally between the first leg 46 and the second leg 48. The first leg 46 forms one side 42 of the support structure 14. The second leg 48 forms the opposite side 44 of the support structure 14. The first leg 46 and the second leg 48 extend upwardly from the base 12 at a generally acute angle. The third leg 50 is positioned so as to extend vertically from the base 12 in generally equidistant relationship to the first leg 46 and the second leg 48. A first gusset 51 is affixed to the base 12 and is joined to the exterior surface at a bottom of the first leg 46. Similarly, a second gusset (not shown in FIG. 1) is joined to the exterior surface of a bottom of the second leg 48 and affixed to the base 12. A cross member 52 extends between the first leg 46, the third leg 50 and the second leg 48 in generally parallel relationship to the base 12. Openings 54, 56, 58 and 60 are formed through the support structure 40 so as to allow concrete to flow freely therethrough. Openings 54 and 56 are positioned between the cross member 52 and the base 12. Openings 58 and 60 are positioned on opposite sides of the third leg 50 generally below the channel 20.

As can be seen in FIG. 1, the first clamping structure 16 and the second clamping structure 18 are positioned above the channel 20. In the present invention, the base 12, the support structure 14, the first clamping structure 16 and the second clamping structure 18 are integrally formed together of a nylon material. Experiments with the present invention have found that the water retention characteristic of nylon used for the formation of the concrete reinforcing bar support 10 adds benefits in an unexpected manner to the structure of the bar support 10. When used in association with concrete, nylon fibers within the matrix add strength to the concrete structure. The increased bond between the nylon material of the bar support 10 and the associated concrete improves the life cycle of the concrete structure. In other words, the use of such nylon material enhances durability and reduces maintenance costs when compared to other forms of plastic material used for chairs, such as polyethylene, polypropylene, and polystyrene. The nylon fibers used within the concrete reinforcing bar support 10 provide an isotropic reinforcement that proactively inhibits cracking and adds long-term durability at relatively less costs than other reinforcing bar support materials.

Figure 2:
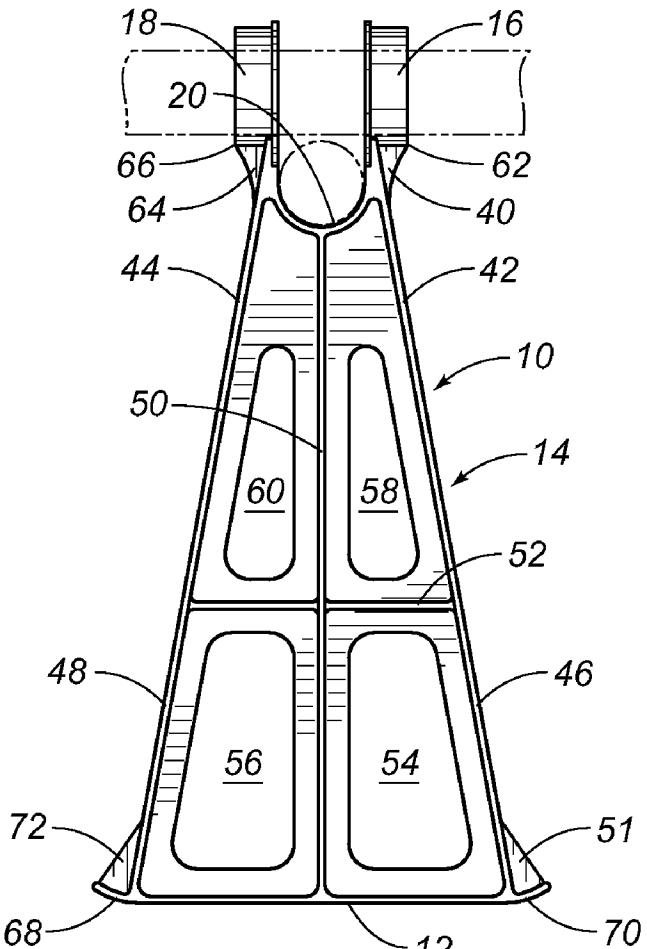
FIG. 2 is a frontal view of the reinforcing bar support of the present invention.

FIG. 2 shows a side elevation view of the concrete reinforcing bar support 10. In particular, in FIG. 2, it can be seen how the first clamping structure 16 is positioned in generally parallel relationship to the second clamping structure 18 on opposite sides of the channel 20. The gusset 40 is illustrated as joined to the side 42 of the support structure 14 and also joined to the underside 62 of the first clamping structure 16. Anther gusset 64 is joined to the underside 66 of the second clamping structure 18 and is also joined to the opposite side 44 of the support structure 14. The use of the gussets 40 and 64 greatly enhances the structural integrity of the clamping structures 16 and 18 and serves to resist downwardly deformation. Additionally, during dragging tests, the forces imparted by the gussets 40 and 64 greatly avoid the deformation and distortion of the clamping structures 16 and 18 such that the concrete reinforcing bar support 10 can withstand conventional dragging tests.

In FIG. 2, it can be also seen that the base 12 has slightly upwardly flaired ends 68 and 70. These flaired ends 68 and 70 enhance the ability of the concrete reinforcing bar support 10 to slightly slide during the dragging tests. As a result, the wire mesh and/or rebar can be suitably dragged without significant impairment or improper forces being imparted between the outwardly extending flaired ends 68 and 70 of the base 12. A gusset 72 is formed on the end 68 of base 12 and is joined to the exterior surface of the leg 48 at the bottom thereof. Similarly, gusset 51 is secured to the end 70 of the base 12 and also to the exterior surface at the bottom of leg 46. Once again, the use of gussets 51 and 72 greatly improves the structural integrity associated with the reinforcing bar support 10 of the present invention.

In FIG. 2, cross member 52 is shown as integrally formed with the third leg 50, along with the legs 46 and 48. Similarly, it can be seen that the cross member 52 is in generally parallel planar relationship to the base 12. Openings 56 and 58 are of a generally oval or rectangular configuration and are respectively positioned on opposite sides of the third leg 50 between the cross member 52 and the base 12. Openings 58 and 60 are formed above the cross member 52 and are of generally oval configuration. The openings 54, 56, 58 and 60 allow a free flow of concrete therethrough so as to enhance the ability of the concrete reinforcing bar support to be fully secured within the concrete structure.

Figure 3:
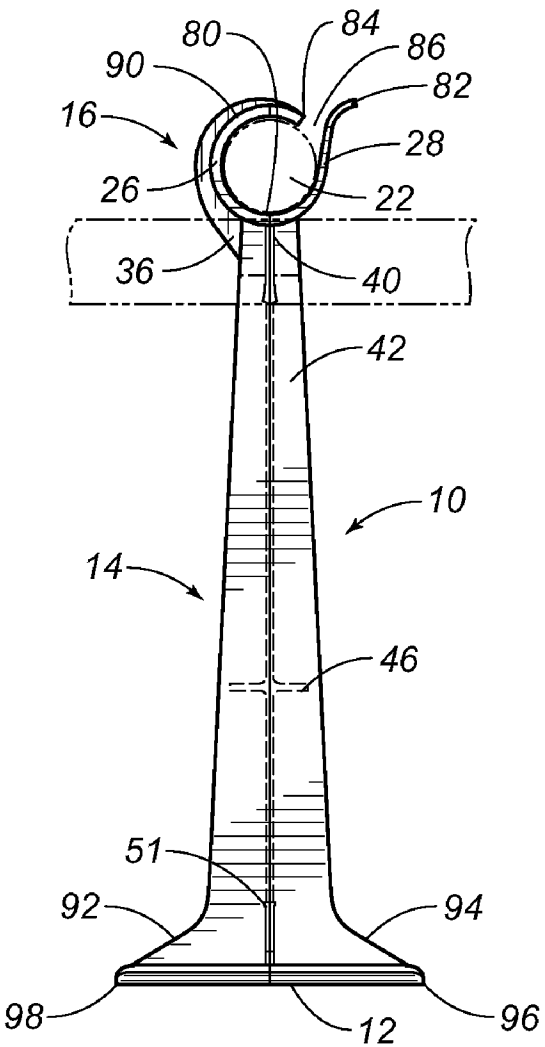
FIG. 3 is a side elevational view of the reinforcing bar support of the present invention.

FIG. 3 shows a detailed view of the first clamping structure 16 of the concrete reinforcing bar support 10. In particular, it can be seen that the first clamping structure 16 includes the C-shaped member 26 and the arm 28 extending upwardly from the bottom 80 of the C-shaped member. A lip 82 is formed in the upper portion of the arm 28 so as to extend outwardly from the upper end 84 of the C-shaped member 26. The space 86 between the lip 82 and the upper end 84 of the C-shaped member 26 should be less than the diameter of the rebar received within the interior 22 of the first clamping structure 16. As a result, the rebar can be placed into the space 86, pushed downwardly thereupon so that the flexibility between the arm 28 and the C-shaped member 26 allows the rebar to pass into the interior 22. The interior surface 88 of the C-shaped member 26 will serve to secure the rebar within the opening 22. Similarly, the curved upper end 84 of the C-shaped member 26 will retain the rebar within the opening 22 during dragging tests. The rib 36 is illustrated as extending around the exterior surface 90 of the C-shaped member 26. The rib 36 has a greater thickness at the bottom C-shaped member 26 than at the top thereof. The gusset 40 is illustrated as formed centrally at the bottom 80 of the C-shaped member 26 and also joined to the side 42 of the support structure 14. The second clamping structure 18 has an identical configuration to that of the clamping structure 16, but positioned on the opposite side of the channel 20.

In FIG. 3, it can be seen that the base 12 has gusset 50 extending upwardly therefrom so as to be joined to the bottom of leg 46 on side 42 of support structure 14. The width of the base 12 is slightly greater than the width of the side 42 or the leg 46 of the support structure 14. The leg 46 has outwardly tapering portions 92 and 94 which extend outwardly to the front 96 and the back 98 of base 12. These extended portions 92 and 94 provide a firm footing for the structural integrity of the support structure 14.

Figure 4:
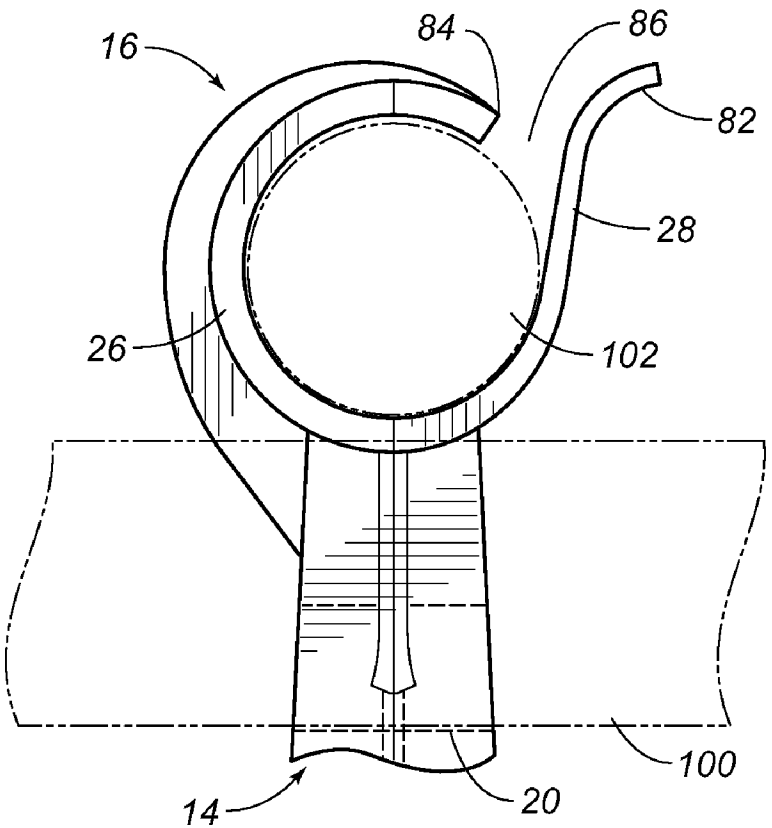
FIG. 4 is a diagrammatic illustration showing the manner in which the clamping structures of the present invention serve to receive rebars therein.

FIG. 4 illustrates the positioning of a rebar 100 within the channel 20 of the support structure 14. Similarly, a second rebar 102 is illustrated as positioned within the interior of the first clamping structure 16. The second rebar 102 will extend in generally transverse relationship to the first rebar 100. The second rebar 102 is retained in a desired position by the upper end 84 of C-shaped member 26 of the first clamping structure 16 and also by the retention forces imparted by the arm 28. It can be seen that the space 86 between the end 84 and the lip 82 of the arm 28 is less than the diameter of the rebar 102. The placement of the rebar 102 within the interior of the clamping structures 16 and 18 will also serve to retain the transverse rebar 100 in a desired position within channel 20.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

a base;

a support structure extending upwardly from said base, said support structure having a channel formed in an upper surface thereof;

a first clamping structure affixed to said support structure on one side of said channel;

a second clamping structure affixed to said support structure on an opposite side of said channel and arranged in generally spaced parallel relationship to said first clamping structure, each of said first and second clamping structures having a generally C-shaped configuration;

a first rebar extending in a direction and received in said channel of said support structure; and a second rebar retained by said first and second clamping structures in a position transverse to said first rebar and above said first rebar, said first and second clamping structures having an upper surface directly overlying a top of said second rebar, said base and said support structure and said first clamping structure and said second clamping structure being integrally formed together of a polymeric material, said support structure comprising:

a first leg extending upwardly from one side of said base;

a second leg extending upwardly from an opposite side of said base; and a third leg extending upwardly from said base between said first and second legs, said first and second legs extending at an acute angle upwardly from said base, said third leg extending upwardly vertically from said base so as to be positioned generally equidistant between said first and second legs, each of said first and second clamping structures comprising:

a generally C-shaped member extending flexibly upwardly from said support structure; and an arm extending upwardly from a bottom of said generally C-shaped member, said arm having an upper portion in spaced relationship to a top of said generally C-shaped member, said arm having a lip at said upper portion, said lip extending in an direction away from said top of said C-shaped member, said upper portion of said arm being spaced from said top of said C-shaped member by a distance less than a diameter of the second rebar, said arm being flexibly connected to said bottom of said C-shaped member.

2. The apparatus as recited in claim 1, further comprising said first clamp having a rib formed therewith and extending outwardly of an exterior of said first clamping structure, said second clamping structure having a rib formed therewith and extending outwardly of an exterior of said second clamping structure, said rib of first clamping structure formed on a surface of said first clamping structure adjacent said channel, said rib of said second clamping structure formed on a surface of said second clamping structure adjacent said channel.

* * * * *